US009766579B2

(12) United States Patent
Ikegami et al.

(10) Patent No.: US 9,766,579 B2
(45) Date of Patent: Sep. 19, 2017

(54) FIXING APPARATUS FOR AN ELECTROGRAPHIC OR ELECTROSTATIC IMAGING FORMING APPARATUS

(71) Applicant: CANON KABUSHIKI KAISHA, Tokyo (JP)

(72) Inventors: Shoichiro Ikegami, Yokohama (JP); Masahito Omata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/005,896

(22) Filed: Jan. 25, 2016

(65) Prior Publication Data

US 2016/0216659 A1 Jul. 28, 2016

(30) Foreign Application Priority Data

Jan. 27, 2015 (JP) ..... 2015-013724

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2025
USPC ..... 399/329
See application file for complete search history.

(56) References Cited

U.S. PATENT DOCUMENTS

2004/0151522 A1* 8/2004 Kato ..... G03G 15/2025 399/328
2005/0006370 A1* 1/2005 Suzumi ..... H05B 3/0095 219/216
2009/0304421 A1* 12/2009 Saito ..... G03G 15/2053 399/329
2014/0138372 A1* 5/2014 Ogura ..... G03G 15/2042 219/216
2014/0186078 A1* 7/2014 Imaizumi ..... G03G 15/2017 399/329

FOREIGN PATENT DOCUMENTS

JP 11-084919 A 3/1999

OTHER PUBLICATIONS

Bakish et al., Thermal Conductivity of Anisotropic Aluminum, Journal of Applied Physics, 39, 4473 (1968).*

* cited by examiner

*Primary Examiner* — Walter L Lindsay, Jr.
*Assistant Examiner* — Arlene Heredia Ocasio
(74) *Attorney, Agent, or Firm* — Canon U.S.A., Inc. IP Division

(57) ABSTRACT

A fixing apparatus which fixes a toner image on a recording material, includes a tubular film; a heater disposed in contact with the film, the heater including a substrate and a heat generating resistor formed on the substrate; a contact member disposed in contact with a surface of the heater opposite to a surface of the heater in contact with the film, a coefficient of linear expansion of the contact member being larger than that of the substrate; and a support member configured to support the heater, the support member sandwiching the contact member with the heater, wherein a lubricant is applied in at least a longitudinal end portion of a contact region between the heater and the contact member.

10 Claims, 4 Drawing Sheets

FIXING APPARATUS FOR AN ELECTROGRAPHIC OR ELECTROSTATIC IMAGING FORMING APPARATUS

BACKGROUND OF THE INVENTION

Field of the Invention

The present invention relates to a fixing apparatus provided in an electrophotographic or electrostatic image forming apparatus, such as a laser beam printer and an LED printer.

Description of the Related Art

As a fixing apparatus provided in, for example, an electrophotographic image forming apparatus, a fixing apparatus using a tubular film is proposed. Such a fixing apparatus is typically provided with a tubular film, a heater disposed in contact with an inner surface of the film, and a pressure member that forms a nip portion via the film with the heater, and heats a toner image while conveying, at the nip portion, a recording material which bears the toner image.

The fixing apparatus using the film with small heat capacity is short in warm-up time, whereas a temperature rise in a sheet non-passing portion, i.e., an excessive temperature rise in a region in which no recording material passes often occurs. Then, Japanese Patent Application Laid-open No. 11-84919 discloses a configuration in which a thermally conductive member is provided between a heater and a support member to make heat in a heater plane move easily and to make temperature distribution of the heater in the longitudinal direction uniform.

The following problem occurs, however, in the configuration in which the thermally conductive member is nipped between the heater and the support member as disclosed in Japanese Patent Application Laid-open No. 11-84919. When thermal expansion and thermal contraction of the thermally conductive member are repeated, the thermally conductive member contracts in the longitudinal direction, and an effect of controlling the temperature rise in the sheet non-passing portion may be reduced.

SUMMARY OF THE INVENTION

The present invention provides a fixing apparatus which fixes a toner image on a recording material, including: a tubular film; a heater disposed in contact with the film, the heater including a substrate and a heat generating resistor formed on the substrate; a contact member disposed in contact with a surface of the heater opposite to a surface of the heater in contact with the film, a coefficient of linear expansion of the contact member being larger than that of the substrate; and a support member configured to support the heater, the support member sandwiching the contact member with the heater, wherein a lubricant is applied in at least a longitudinal end portion of a contact region between the heater and the contact member.

Further features of the present invention will become apparent from the following description of exemplary embodiments with reference to the attached drawings.

DESCRIPTION OF THE EMBODIMENTS

Hereinafter, preferred embodiments of the present invention will be described with reference to the drawings.

First Embodiment (1) Example of Image Forming Apparatus

Figure 5:
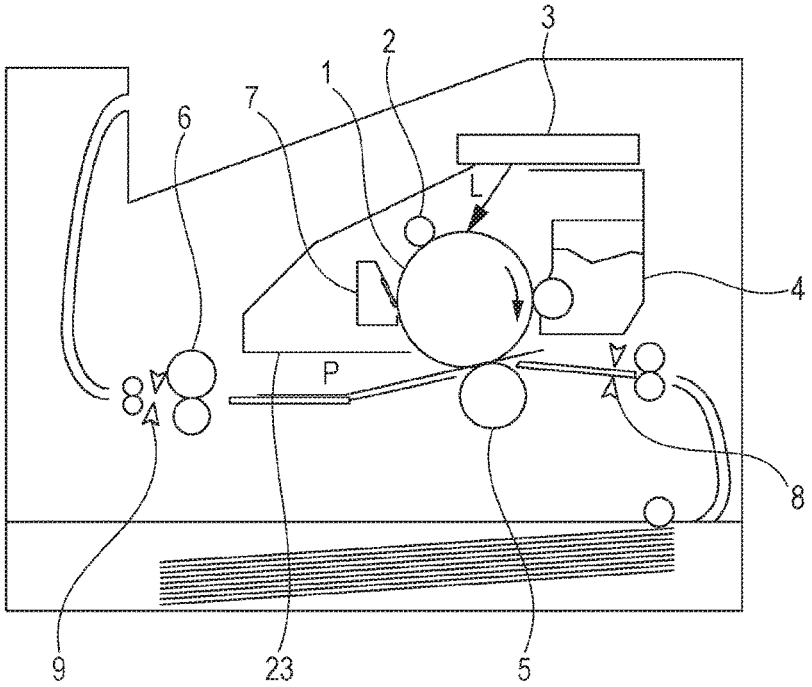
FIG. 5 is a cross-sectional view of an image forming apparatus according to the first embodiment.

FIG. 5 is a schematic configuration diagram of an image forming apparatus of the present embodiment.

In a photoconductive drum 1, a photosensitive material, such as OPC, amorphous Se and amorphous Si, is formed on a cylindrical base made of, for example, aluminum or nickel. The photoconductive drum 1 is rotated in the arrow direction, and a surface of the photoconductive drum 1 is charged uniformly by a charging roller 2 as a charging device. Next, scanning exposure with a laser beam L of which ON/OFF is controlled in accordance with image information is conducted by a laser scanner 3, whereby an electrostatic latent image is formed. The electrostatic latent image is developed and visualized by a developing device 4. A non-contact jumping developing method using a one-component developer is used as a developing method, and image exposure and reversal development are often employed in combination.

The visualized toner image is transferred from the photoconductive drum 1 to a recording material P conveyed at predetermined timing by a transfer roller 5 as a transfer device. A leading end of the recording material is detected by a sensor 8 so that an image forming position of the toner image on the photoconductive drum 1 and a transfer starting position at the leading end of the recording material are aligned with each other to set the timing. The recording material P conveyed at the predetermined timing is nipped by the photoconductive drum 1 and the transfer roller 5 with constant pressure and conveyed. The recording material P with the toner image transferred thereto is conveyed to a fixing apparatus 6, by which the toner image is fixed as a permanent image. Residual toner that has not been transferred and remained on the photoconductive drum 1 is removed from a surface of the photoconductive drum 1 by a cleaning device 7. The reference numeral 9 denotes an output sensor provided in the fixing apparatus 6. If, for example, a paper jam occurs between the top sensor 8 and the output sensor 9, the output sensor 9 detects the paper jam.

(2) Fixing Apparatus 6

Figure 6A:
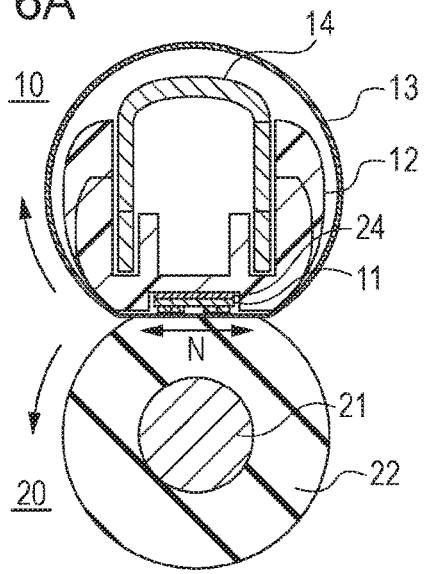
FIG. 6A is a transverse cross-sectional view of a fixing apparatus according to the first embodiment.
Figure 6B:
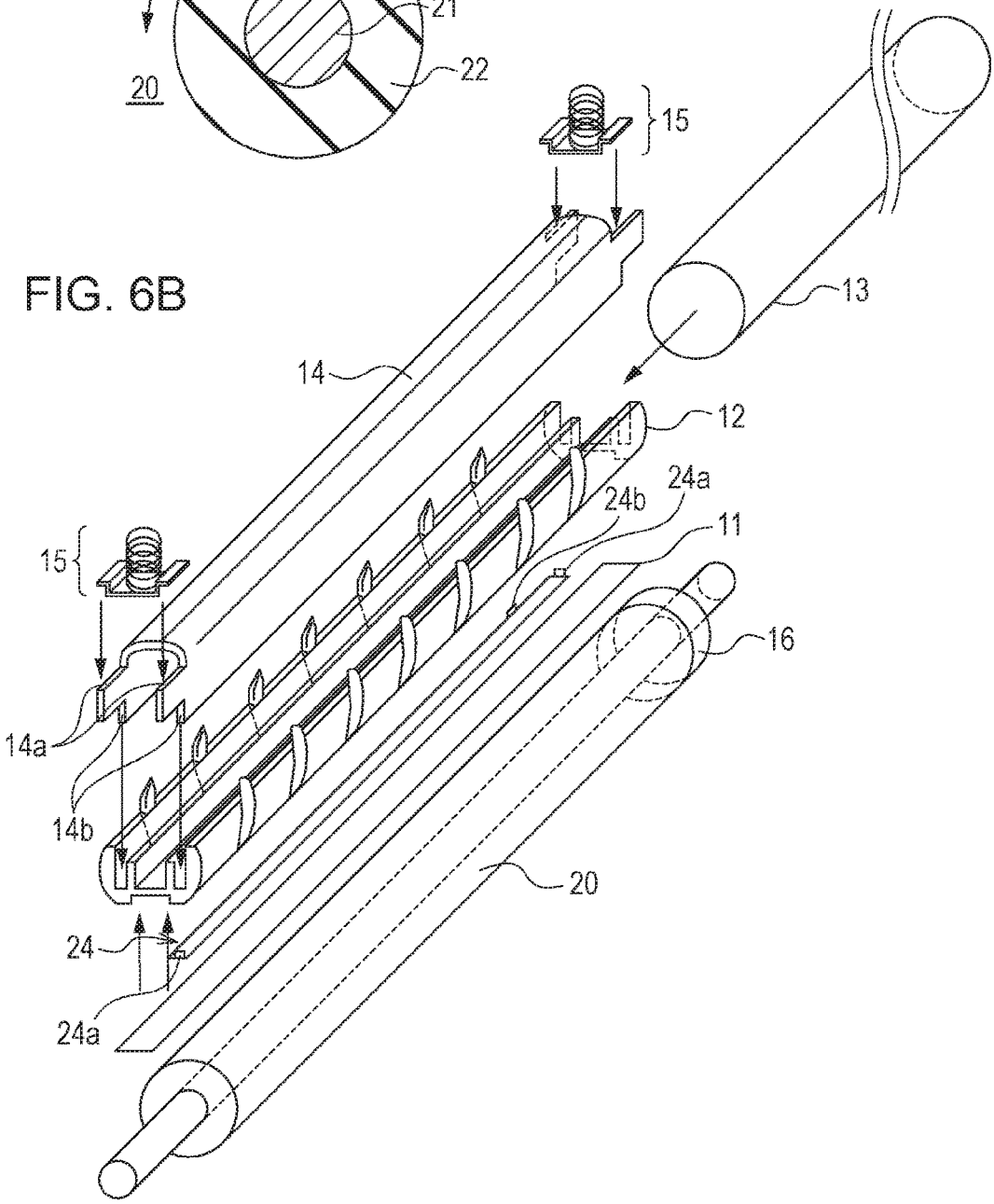
FIG. 6B is an exploded perspective view of the fixing apparatus according to the first embodiment.

FIGS. 6A and 6B are schematic diagrams of the fixing apparatus 6 in the present embodiment. The fixing apparatus 6 is provided with a film unit 10 as a heating member, and a pressure roller 20 as a pressure member. The fixing apparatus 6 is illustrated in a cross-sectional view in FIG. 6A and in a perspective view in FIG. 6B. The film unit 10 is provided mainly with a film 13, a heater 11 disposed in contact with an inner surface of the film 13, a thermally conductive member (i.e., a contact member) 24 disposed in contact with the heater 11 on a surface opposite to the surface in contact with the film 13, and a support member 12 which supports the heater 11 via the thermally conductive member 24. The film unit 10 is further provided with a metal stay 14 for increasing bending rigidity of the film unit 10.

a) Film 13

The film 13 is a tubular heat-resistant film. The film 13 has a base layer made of heat-resistant resin, such as polyimide, polyamidoimide and PEEK, or metal, such as stainless steel and nickel. Regarding the heat-resistant resin as the material of the base layer, high thermally conductive powder of BN, alumina, Al, and the like may be mixed to enhance thermal conductivity. The total thickness of the film 13 is desirably equal to or greater than 20 μm and equal to or smaller than 200 μm to have low heat capacity and durability. A mold release layer made of fluororesin, such as tetrafluoroethylene-perfluoroalkyl vinyl ether copolymer (PFA) is formed on a surface layer for offset prevention or to provide releasability of the recording material. As a coating method, the mold release layer may be dipped after an outer surface of the film 13 is etched, or may be coated by powder coating. Alternatively, the mold release layer may be formed by coating the surface of the film 13 with tube-shaped resin. Alternatively, after blasting an outer surface of the film 13, a primer layer which is an adhesive layer may be applied and a mold release layer may be coated thereon, or the mold release layer may be a single layer molded from a material with high releasability. In this example, the base layer is made of polyimide which is 55 μm in thickness, an adhesive layer is provided on the base layer, a surface layer is made of PFA coated with a conductive material to 10 μm in thickness, 70 μm in total thickness and 18 mm in diameter. The thermal conductivity is enhanced by mixing high thermally conductive powder in the base layer.

b) Pressure Roller 20

The pressure roller 20 is provided with a core metal 21 and an elastic layer 22 formed outside the core metal 21. The core metal 21 is formed by metal, such as stainless steel. The elastic layer 22 formed by heat-resistant rubber, such as silicone rubber. A mold release layer made of, for example, PFA, may be formed outside the elastic layer 22. In this case, the silicone balloon rubber layer is 3.5 mm in thickness, 20 mm in diameter the surface layer is made of PFA, 20 μm in thickness, and 49 degrees in product hardness by Asker C hardness.

c) Heater 11

In the heater 11, on a surface of an elongated substrate 11*a* made of ceramic, such as alumina and aluminum nitride, a heat generating resistor 11*b* made of Ag palladium (Ag/Pd), $RuO_2$, $Ta_2N$, and the like is formed by, for example, screen printing in about 10 μm in thickness and about 1 to 5 mm in width in a longitudinal direction of the substrate 11*a*. The heat generating resistor 11*b* is connected with an unillustrated electrode portion via an unillustrated conductor. Power is supplied to the heater by an unillustrated connector or the like via the electrode portion. A protective layer 11*c* for protecting the heat generating resistor 11*b* is provided on a surface where the heater 11 is in contact with the film 13. The thickness of the protective layer 11*c* is desirably thin enough to enhance surface properties, and is coated with glass, fluororesin or the like. In this case, the substrate 11*a* is made of alumina which is 1 mm in thickness, 5.83 mm in width in the conveyance direction, and 270 mm in length in the longitudinal direction. The heat generating resistor 11*b* made of Ag palladium is formed on the substrate 11*a* in 1 mm in width and 218 mm in length in the longitudinal direction, and 60-μm-thick glass is coated as the protective layer 11*c*. The total resistance value of the heater 11 is 13.8Ω and supplied power is 1043W when rated 120V is input.

d) Heat-Conductive Member 24

The thermally conductive member 24 is used to control, by a heat equalization effect, a temperature rise in a sheet non-passing portion caused when fixing is conducted on small-sized recording materials continuously. Although aluminum is used as a material of the thermally conductive member 24 in the present embodiment, any other metal materials with enough thermal conductivity, such as Cu and Ag, may be used. An aluminum plate 24 is provided with bent portions 24*a* bent at both end portions in the longitudinal direction in the direction to approach the support member 12, and bent portions 24*b* provided at end portions in the width direction. The aluminum plate 24 is installed in the support member 12 with these bent portions 24*a* and 24*b* inserted in holes (not illustrated) formed in the support member 12. The bent portion 24*b* regulates movement in the longitudinal direction and the bent portions 24*a* regulate movement in the thickness direction. The heater 11 is installed on the aluminum plate 24. The central portion of the heater 11 in the longitudinal direction is supported by the heater support member 12 via the aluminum plate 24, and both end portions of the heater in the longitudinal direction are supported by the support member 12 in a contact manner. In the present embodiment, the aluminum plate 24 is 0.3 mm in thickness, 5.5 mm in width in the conveyance direction, and 218 mm in length in the longitudinal direction, and is disposed on a surface of the substrate of the heater 11 opposite to the surface on which the heat generating resistor is provided.

e) Support Member 12

The support member 12 supports the heater 11, the aluminum plate 24 and the like, and is made of heat-resistant resin, such as liquid crystal polymer, phenol resin, PPS, and PEEK. The support member 24 sandwiches the aluminum plate 24 with the heater 11. The lower the thermal conductivity, the higher the thermal conduction to the pressure roller 20 becomes. Therefore, the resin layer may contain a filler, such as a glass balloon and a silica balloon. The support member 12 also has a function to guide the rotation of the film 13. The support member 12 is provided with an elongated groove in the longitudinal direction. The aluminum plate 24 and the heater 11 are disposed on a support surface in the groove. The heater 11 is supported by the support surface of the support member via the aluminum plate 24. The support surface is provided with a crown shape projecting toward the pressure roller 20 more at central portion than at both end portions in the longitudinal direction. The reason for this is described later. The metal stay 14 is provided on the surface of the support member 12 opposite to the surface on which the heater 11 is supported.

f) Method for Driving and Controlling Fixing Apparatus 6

The film unit 10 is pressed against the pressure roller 20 by the following configuration against elasticity of the pressure roller 20 and forms a predetermined nip N. That is, as illustrated in FIG. 6B, both end portions of the metal stay 14 in the longitudinal direction project from the support member 12 of the heater 11, and spring brackets 14*a* located at both end portions of the metal stay 14 are pressurized by springs 15 via spring bracket members. Load is transmitted over the longitudinal direction of the support member 12 via stay feet 14*b*. The pressurizing spring 15 is lifted and separated by an unillustrated separation mechanism when a cartridge is attached or detached. In this case, pressure force of 15 kgf is applied to the nip portion N. Pressure distribution of the nip portion N in the longitudinal direction in the present embodiment is designed such that the pressure is greater at the central portion than at both end portions by the crown shape of the support surface of the support member 12 described above. In the nip portion N, the film 13 is bent by being nipped between the heater 11 and the pressure roller 20 with the pressure force, and is brought into close contact with the heater 11.

The pressure roller 20 obtains driving force to rotate in the arrow direction of FIG. 6A by an unillustrated driving gear provided at the end portion of the core metal 21. The driving force is transmitted from an unillustrated motor according to instructions from an unillustrated CPU which controls a control unit. In this case, driving is controlled such that a peripheral speed is 220 mm/sec and printing can be made on 38 A4-sized paper sheets per minute.

As the pressure roller 20 is driven to rotate, the film 13 is rotated following the rotation of the pressure roller 20 by the frictional force between the film and the pressure roller 20. A lubricant, such as fluorine-based or silicone-based heat-resistant grease, is disposed between the film 13 and the heater 11, whereby frictional resistance can be reduced and the film 13 can rotate smoothly. The potential of the film 13 is controlled to an appropriate value by an unillustrated bias application circuit via a conductive rubber ring 16 as illustrated in FIG. 6B.

The heater 11 is controlled in accordance with signal of an unillustrated temperature detection element, such as a thermistor, provided on the surface of the heater 11 opposite to the surface in contact with the film 13 via the aluminum plate 24, so as to keep the temperature of the nip N at a desired target temperature. The recording material P bearing an unfixed toner image is heated and pressurized while being conveyed by the nip N. The recording material P discharged from the nip N is guided by an unillustrated sheet discharge guide and discharged.

(3) Characteristic Configuration of the Present Embodiment

First, a problem of the present embodiment is described in detail. In a fixing apparatus in which no lubricant exists between the heater 11 and the aluminum plate 24, the following problems occur when the temperature of the fixing apparatus repeatedly increases and decreases. If the heater 11 and the aluminum plate 24 expand thermally, a difference between linear expansion coefficients of these two members causes frictional force between these members and generates stress in the aluminum plate 24. The stress is often generated at end areas of the aluminum plate 24 in the longitudinal direction. This is considered to be because edges of the end portions of the aluminum plate 24 in the longitudinal direction are often caught by the heater 11 when expanding thermally and therefore stretching due to thermal expansion is regulated. When the stress is generated repeatedly at the end portions of the aluminum plate 24, a problem may be caused that the aluminum plate 24 contracts in the longitudinal direction and an effect of controlling the temperature rise in the sheet non-passing portion is reduced. Especially, if aluminum is used as the material of the thermally conductive member 24 and ceramic is used as the material of the substrate of the heater 11, since aluminum is higher in linear expansion coefficient and lower in hardness than ceramic, the aluminum plate 24 is more easily deformed.

Figure 1:
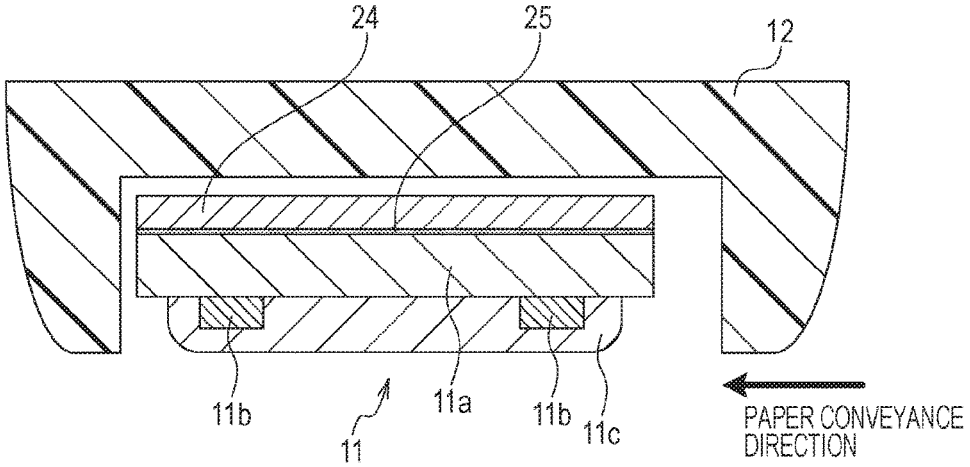
FIG. 1 is a transverse cross-sectional view of a heater, a thermally conductive member, and a support member according to a first embodiment.

FIG. 1 is a transverse cross-sectional view of the heater 11 and the aluminum plate 24 according to the present embodiment. A characteristic configuration of the present embodiment is that grease 25 as a lubricant is applied a contact region between the heater 11 and the aluminum plate 24. Even if a difference in thermal expansion occurs between the heater 11 and the aluminum plate 24, the frictional force between the heater 11 and the aluminum plate 24 is weakened by the existence of the grease 25 disposed therebetween and generation of stress is reduced. In the present embodiment, 75 mg of silicone grease (HP-300 manufactured by Dow Corning Toray Co., Ltd.) is applied to the entire region of the aluminum plate 24 in contact with the heater 11, and the heater 11 is disposed thereon.

(4) Effect of the Present Embodiment

To confirm the effect of the present embodiment, experiments are conducted using a configuration of the present embodiment in which the grease 25 is disposed between the heater 11 and the aluminum plate 24, and a configuration of Comparative Example in which no grease 25 is disposed between the heater 11 and the aluminum plate 24. Each three samples are used of the present embodiment and Comparative Example and evaluated.

As the experiment, the aluminum plate 24 is repeatedly subject to thermal expansion and thermal contraction to conduct a heating/cooling cycle evaluation that causes deformation of the aluminum plate 24, and a deformation amount of the aluminum plate 24 is measured. The heating/cooling cycle evaluation is conducted by repeatedly conducting 200 times the cycle of the printer body is heated and driven for 10 minutes at controlled temperature 220°, and then stopped for 10 minutes and air-cooled with a fan. The evaluation environment is as follows: the room temperature is 25°, and the humidity is 55%. In addition, an evaluation on a temperature rise in the sheet non-passing portion is conducted as confirmation regarding influences on functional changes of the aluminum plate 24 using the fixing apparatus 6 after the heating/cooling cycle evaluation. In the evaluation on the temperature rise in the sheet non-passing portion, the maximum surface temperature of the pressure roller 20 in the sheet non-passing portion when 200 sheets of Oce Red Label (sheet size: A4, basic weight: 80 g/m$^2$) narrower than the LTR size which is the maximum paper width are passed continuously on one side is measured. The evaluation environment of the sheet non-passing portion temperature rise evaluation is as follows: the room temperature is 15°, the humidity is 10%, and the used paper is sheets immediately after unpackaged. The evaluation result is shown in Table.

TABLE

| | | Contraction of Aluminum Plate (mm) | Temperature in Sheet Non-Passing Portion |
|---|---|---|---|
| Comparative Example | 1st time | 4.8 | 281 |
| | 2nd time | 3.8 | 269 |
| | 3rd time | 4.3 | 274 |
| Present Embodiment | 1st time | 0.1 | 241 |
| | 2nd time | 0.0 | 240 |
| | 3rd time | 0.2 | 243 |

Table shows that the aluminum plate 24 contracted by about 3.8 to 4.8 mm in Comparative Example, whereas almost no contraction occurred in the aluminum plate 24 in the present embodiment. Regarding a non-passing portion end portion, the temperature rise is controlled about 240° which is the design value since there is almost no change in the length of the aluminum plate 24 in the present embodiment, whereas the temperature has risen as high as 269° to 281° with the contraction in Comparative Example. Regarding Comparative Example, it is also considered that, in addition to the influence of the contraction of the aluminum plate 24 in the longitudinal direction, a decrease in adhesiveness to the heater 11 due to deformation at the end portions of the aluminum plate 24 have an influence on the reduction in an effect of controlling the temperature rise in the sheet non-passing portion.

As described above, the present embodiment has the effects of controlling deformation of the thermally conductive member when thermal expansion and thermal contraction of the thermally conductive member are repeated, and reducing a decrease in the effect of controlling the temperature rise of the sheet non-passing portion.

Although the grease 25 is applied to the entire contact region in which the aluminum plate 24 is in contact with the heater 11 in the present embodiment, it is confirmed that the same effect can be obtained if the grease 25 is applied to the end areas of the contact region in the longitudinal direction. This is because the stress generated in the thermally conductive member 24 is often generated at the end portions in the longitudinal direction as described above.

Second Embodiment

Figure 2:
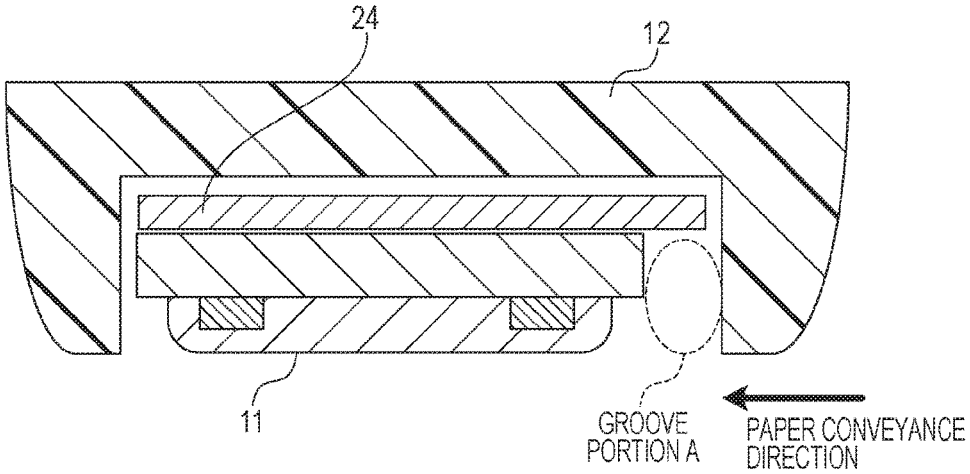
FIG. 2 is a transverse cross-sectional view of a heater, a thermally conductive member, and a support member according to a second embodiment.

FIG. 2 is a transverse cross-sectional view of a heater 11 and an aluminum plate 24 according to the present embodiment. In the first embodiment, the grease 25 is applied and disposed between the heater 11 and the aluminum plate 24 to thereby control deformation resulting from thermal expansion. The first embodiment, however, has an additional manufacturing process of applying the grease 25 to the aluminum plate 24. Then, in the present embodiment, grease 25 applied to a surface of the heater 11 in contact with a film 13 to enhance slidability between the heater 11 and the film 13 is guided between the heater 11 and the aluminum plate 24, whereby a process of applying the grease to the aluminum plate 24 can be omitted. A characteristic configuration of the present embodiment is that a width of the aluminum plate 24 in the width direction is greater than a width of the heater 11 in the width direction as illustrated in FIG. 2. Other configurations are the same as those of the first embodiment and description thereof is omitted.

In the present embodiment, the width of the aluminum plate 24 is set to 6.00 mm whereas the width of the heater 11 is 5.83 mm. The aluminum plate 24 is disposed on a support member 12, the heater 11 is disposed on the aluminum plate 24, and then 225 mg of silicone grease 25 (HP-300, manufactured by Dow Corning Toray Co., Ltd.) is applied on the heater 11. A part of the grease 25 applied on the heater 11 enters grooves and the like in the periphery of the heater 11 and the aluminum plate 24 as the fixing apparatus 6 is operated. In the present embodiment, a part of the grease 25*s* which has entered the groove portion A between the heater 11 and the support member 12 is caught by the projecting aluminum plate 24, and enters between the heater 11 and the aluminum plate 24 by a capillary action. With this configuration, the grease 25 can be disposed between the heater 11 and the aluminum plate 24 even if the grease 25 is not applied to the aluminum plate 24 in the manufacturing process.

As described above, the present embodiment has effects that, in the configuration in which the thermally conductive member is nipped between the heater and the support member, deformation of the thermally conductive member when thermal expansion and thermal contraction of the thermally conductive member are repeated is reduced, and the effect of decreasing the temperature rise of the sheet non-passing portion of the thermally conductive member is kept. The present embodiment further has an effect that the process of applying a lubricant between the heater 11 and the aluminum plate 24 can be omitted.

Next, first and second modifications of the present embodiment are described. First and second modifications are fixing apparatuses with a configuration in which the grease 25 enters between the heater 11 and the aluminum plate 24 more easily is added to the second embodiment.

Figure 3A:
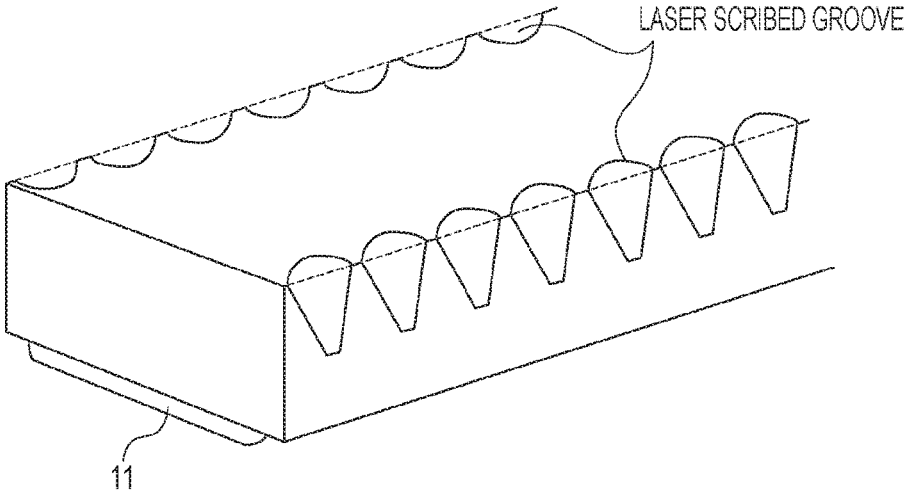
FIG. 3A is a schematic view of a laser scribed substrate according to a first modification of the second embodiment.
Figure 3B:
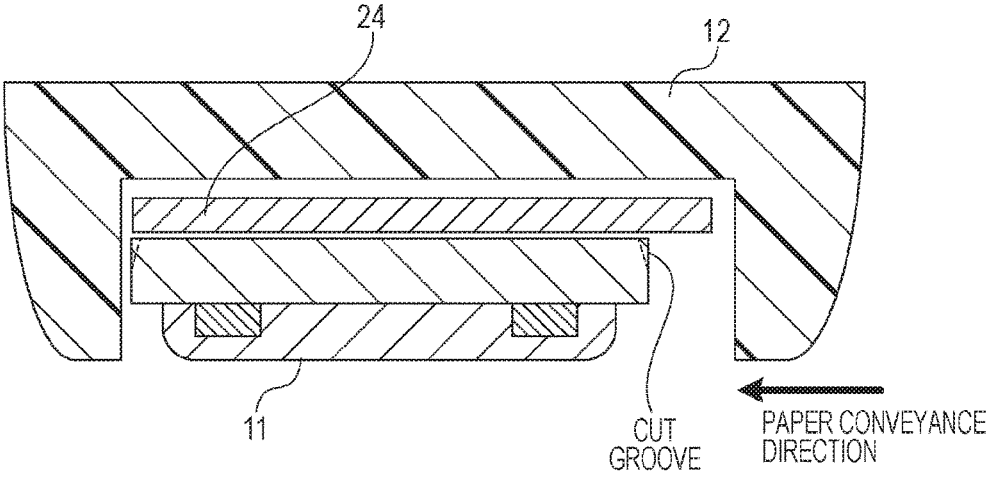
FIG. 3B is a transverse cross-sectional view of a heater, a thermally conductive member, and a support member according to the first modification of the second embodiment.

FIG. 3A is a schematic diagram of the heater 11 having a laser scribed cut surface according to the first modification, and FIG. 3B is a transverse cross-sectional view of the heater 11 and the aluminum plate 24 according to the first modification. The heater 11 has a laser scribed ceramic substrate. As illustrated in FIG. 3A, finely cut grooves are formed in a laser-irradiated portion. In the first modification, the cut grooves formed in the substrate are used. The surface of the heater 11 on which the cut grooves are formed are disposed is disposed to face the aluminum plate 24. In this manner, when the grease 25 coated on the heater 11 enters from a side surface of the heater 11, a capillary action is promoted at the cut grooves and the grease 25 easily enters between the heater 11 and the aluminum plate 24.

Figure 4:
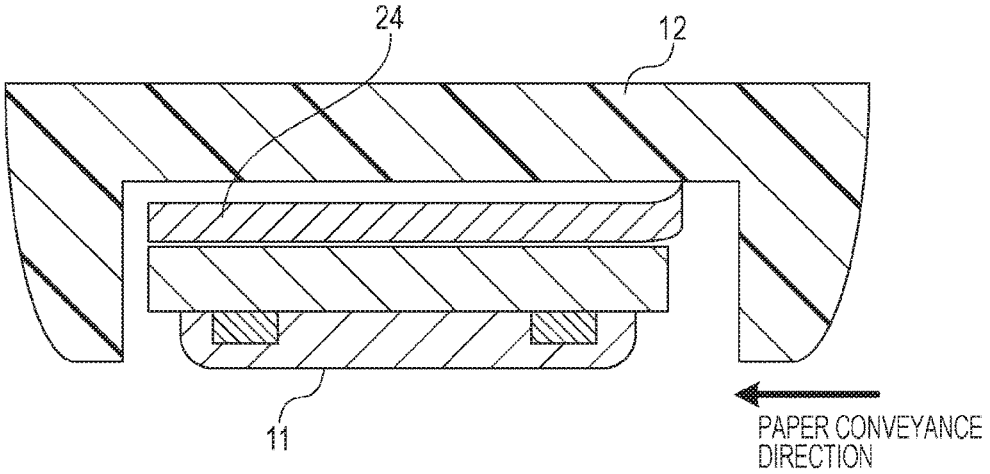
FIG. 4 is a transverse cross-sectional view of a heater, a thermally conductive member, and a support member according to a second modification of the second embodiment.

Next, a second modification of the present embodiment is described. FIG. 4 is a transverse cross-sectional view of a heater 11 and an aluminum plate 24 according to the second modification. Since the aluminum plate 24 is manufactured by punching, burr is formed on a burr surface side and sagging (i.e., a smooth R shape) is formed on a sagging surface side. In the second modification, the aluminum plate 24 is disposed so that the sagging surface side of the aluminum plate 24 faces the heater 11 as illustrated in FIG. 4. In this manner, when the grease 25 coated on the heater 11 enters, a capillary action is promoted at the sagging and the grease 25 easily enters between the heater 11 and the aluminum plate 24.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-013724, filed Jan. 27, 2015 which is hereby incorporated by reference herein in its entirety.

What is claimed is:

1. A fixing apparatus which fixes a toner image on a recording material, comprising:

a tubular film;

a heater disposed in contact with the film, the heater including a substrate and a heat generating resistor formed on the substrate;

a contact member disposed in contact with a first surface of the heater opposite to a second surface of the heater in contact with the film, a thermal conductivity of the contact member being higher than that of the substrate, a coefficient of linear expansion of the contact member being larger than that of the substrate; and a support member configured to support the heater, the support member sandwiching the contact member with the heater, wherein a grease is applied to at least a longitudinal end portion of a contact region between the heater and the contact member, and wherein an outer edge of the surface of the substrate on a first surface side of the heater has cut grooves formed by a laser scribed cut.

2. The fixing apparatus according to claim 1, wherein contact pressure between the heater and the contact member at a longitudinal central portion of the contact region is larger than at the longitudinal end portion of the contact region.

3. The fixing apparatus according to claim 1, wherein a longitudinal central portion of the support member facing the contact member projects toward the contact member more than a longitudinal end portion of the support member facing the contact member.

4. The fixing apparatus according to claim 1, wherein, in the width direction of the heater orthogonal to a longitudinal direction of the heater, a width of the contact member is wider than that of the heater.

5. The fixing apparatus according to claim 1, wherein the grease is applied in a contact region between the film and the heater.

6. The fixing apparatus according to claim 1, further comprising a roller in contact with the film to form a nip portion, at which a recording material on which the toner image is formed is heated while being conveyed, and the toner image is fixed on the recording material.

7. The fixing apparatus according to claim 6, wherein the roller forms the nip portion with the heater via the film.

8. The fixing apparatus according to claim 6, wherein pressure of the nip portion is greater at a longitudinal central portion of the nip portion than at both longitudinal end portions of the nip portion.

9. The fixing apparatus according to claim 1, wherein the grease is applied to an entire region of the contact region.

10. The fixing apparatus according to claim 1, wherein the contact member is an aluminum plate.

* * * * *